United States Patent [19]

Dessauer

[11] Patent Number: 4,867,844

[45] Date of Patent: Sep. 19, 1989

[54] METHOD FOR TREATING PAPER TO IMPROVE THE HOLDOUT CHARACTERISTICS OF PRINTING INKS

[75] Inventor: Guido Dessauer, Tutzing, Fed. Rep. of Germany

[73] Assignee: Hoechst AG, Frankfurt, Fed. Rep. of Germany

[21] Appl. No.: 149,633

[22] Filed: Jan. 28, 1988

Related U.S. Application Data

[63] Continuation of Ser. No. 831,638, Feb. 21, 1986, abandoned.

[30] Foreign Application Priority Data

Feb. 22, 1985 [DE] Fed. Rep. of Germany ..... 3506278

[51] Int. Cl.[4] ..... D21H 1/34

[52] U.S. Cl. ..... 162/135; 162/136; 162/181.8

[58] Field of Search ..... 162/135, 136, 137, 181.6, 162/181.8, 134; 106/DIG. 4, 287.17, 287.3, 287.32, 416, 487; 427/397.7

[56] References Cited

U.S. PATENT DOCUMENTS

| | | | |
|---|---|---|---|
| 2,795,545 | 6/1957 | Gluesenkamp | 162/181.8 |
| 3,276,359 | 10/1966 | Worthen et al. | 162/137 |
| 3,855,147 | 12/1974 | Granquist | 106/287.17 |
| 4,387,132 | 6/1983 | Hain | 162/181.8 |
| 4,412,018 | 10/1983 | Finlayson et al. | 106/287.3 |
| 4,517,112 | 5/1985 | Mardis et al. | 106/287.17 |
| 4,549,930 | 10/1985 | Dessauer | 162/181.8 |

*Primary Examiner*—Peter Chin

*Attorney, Agent, or Firm*—William R. Price

[57] ABSTRACT

A method for treating paper or other fibrous materials to improve the holdout characteristics of printing inks, lacquers and coating compositions. The method involves the application of an organophilic complex of (a) a water-insoluble hydrated cation-exchangeable film-forming smectitic layered silicate having an ion exchange capacity of at least 50 milliequivalents/100 g and (b) an organic radical derived from an onium compound attached thereto.

The organophilic complex forms a barrier layer by reaction with the organic solvent contained in the printing ink, lacquer or other coating composition.

16 Claims, No Drawings

METHOD FOR TREATING PAPER TO IMPROVE THE HOLDOUT CHARACTERISTICS OF PRINTING INKS

REFERENCE TO RELATED APPLICATION

This is a continuation of my application Ser. No. 831,638, filed Feb. 21, 1986 now abandoned.

FIELD OF THE INVENTION

The invention relates to a method for treating paper and other fibrous materials to improve the holdout of printing inks, lacquers and coating compositions, as well as to improve the de-inking of the fibers in recycling of paper.

BACKGROUND OF THE INVENTION

It is known, for example, from European Patent No. 0 017 793, how to improve the printability of paper by incorporating hydratable, film-forming colloidal clays, e.g. bentonite, attapulgite or sepiolite, into the paper pulp. Also, macromolecules of polyglycol, having a molecular weight of 5,000 to 100,000 can be attached to these colloidal clays. The improvement in the calendering and printing properties brought about by these measures consists in an improved "ink hold," i.e. the printing ink does not penetrate so quickly in a short time (between its application on the paper and its drying); instead, the same ink contours as they are applied on the paper are present also on the finished printed and dried paper. If the "ink hold" is poor, the ink penetrates and diffuses into the paper in a wicking action in which it spreads in the paper, resulting in an irregular and unsharp and usually dull graphic picture. The main reason for the improved ink hold is seen in that the hydratable, film-forming, colloidal clays contain a considerable percentage of bound water. At the drying temperatures normally used in a paper machine, this water cannot escape, and as it is not miscible with the solvent of the intaglio ink, it causes a repulsion of the ink, as it were.

When a mixture of colloidal clays and polyglycols is used, it is assumed that the polyglycols, like the water, become embedded between the colloidal clays, hence do not form reaction products, and that because of their wax-like constitution, they improve calenderability of the paper after the drying. A reaction with the organic solvent, in which the printing ink is dissolved or dispersed, does not occur.

The purpose of the present invention is to improve the holdout of organic solvent systems, such as printing inks, lacquers and coating substances, by other means. The problem of holdout is especially pronounced in intaglio gravure printing methods, as intaglio inks, compared with other printing inks (for letterpress or offset printing), must have a much lower viscosity. The invention, therefore, is applicable primarily in the field of intaglio gravure printing, and therefore the following statements relate to this field. Also, the flat structures of fibers which are to be printed according to the invention involve primarily those of paper, although nonwoven materials or textiles (e.g. silk, cotton and linen fabrics) can be printed using the present invention.

Intaglio gravure printing is one of the most widely spread printing methods in mass-produced printed matter of any kind. Two paper grades are used essentially, namely:

1. the highly filled, supercalendered, usually wood-containing intaglio printing paper in weights between 40 to about 80 g/m$^2$ and
2. the coated, wood-containing or wood-free, highly-calendered intaglio printing paper in weights between 45 and about 135 g/m$^2$.

For economic and mailing reasons, the tendency has existed for years to reduce the basic weights of such papers. This desire finds limits in particular in coated intaglio printing paper, but also in uncoated (natural) such paper. To have a good standing of the intaglio ink on the paper surface, the coating must, for the coated grades, have a minimum coating weight of about 6.5 to 7 g/m$^2$ per side; for intaglio printing paper coated on both sides, there results from this at a total weight of approximately 50 g/m$^2$, a raw paper to be coated of about 36 g/m$^2$. In light of today, this is a lower limit, as it is only the fiber bonds of the raw paper that contribute to the physical strength values of the printing paper.

On the other hand, the uncoated, natural intaglio printing papers are not equivalent either in whiteness or in the gloss of the producible printed matter to the coated intaglio printing papers. The consumption of intaglio ink is about two and a half to three times that of the coated papers, because the porosity and hence the absorbancy of the natural intaglio gravure papers is substantially greater. Consequently, the strike through of the print on the back (the so-called print opacity) is a special problem with these papers if the weight is further reduced.

Through the use of hydratable film-forming colloidal clays described in the above mentioned European Patent No. 0,017,793, it has indeed been possible to a certain degree to close the surface of the uncoated intaglio gravure papers somewhat and to improve the printability. However, these thus treated gravure papers do not even approximately compare with the coated intaglio gravure papers in ink absorption. However, use of the hydrated film-forming clays described in EUP 0,017,793 in coating formulations or as a surface coat is impossible for rheological reasons.

SUMMARY OF THE INVENTION

It is the object of the invention to treat the surface of flat structures of fibers, in particular paper, in such a way that the low viscosity gravure ink, lacquers or coating materials dissolved in an organic solvent penetrate into the paper as little as possible. The less the penetration, the lower is the ink consumption and the finer will be the printing gloss.

The subject of the invention thus is primarily a method of treating paper to improve the holdout of printing inks, lacquers and coating compositions, containing organic solvents, on flat fibrous structures such as paper, and to improve the de-inking of the fibers. The treatment involves the introduction of water-insoluble substances into the fibrous material or onto the surface of the fibrous structure.

The method is characterized in that an organophilic complex of (a) a water-insoluble hydrated cation-exchangeable film-forming smectitic layered silicate having an ion exchange capacity of at least 50 milliequivalents/100 g and (b) an organic radical, derived from an onium compound attached thereto by ion bond, is introduced into the fibrous material or onto the surface of the fibrous structure so that the organophilic complex forms a barrier layer by reaction with the organic solvent.

DESCRIPTION OF THE PREFERRED EMBODIMENT

The organic radical, which has as a rule a molecular weight of less than 1000, is bound to the inorganic layered silicates in an ion bond. The property of the inorganic layered silicate of forming a gel in the aqueous phase is evidently important in order that also the organophilic complex will react with the organic solvent and will swell, with gel formation. As the organic radical is to be bound to the inorganic layer silicate via an ion bond, the inorganic layered silicate appropriately must have a high ion exchange capacity.

It is assumed that the organophilic complex produces with the organic solvent a more or less strong swelling reaction. This swelling reaction is, surprisingly, so strong and also so fast that the capillary forces of the fibrous flat structure or also of a coating, in particular of a natural paper sheet, do not become active. The possibility of absorption of the inks only or of their binders on the particles of the organophilic complex can be disregarded, as the holdout behavior of the treated surface is practically just equivalent for the pure solvent as for the solution or dispersion of the printing ink, lacquer or coating material.

The organophilic complex is prepared by using a fully hydrated, cation-exchangeable colloidal film-forming smectitic layered silicate having an ion exchange capacity of 50 to 130 meq/100 g. A preferred milliequivalent range is from 70 to 100. The production of the organophilic complex requires that at least 50% of the exchangeable cations are exchanged by organic radicals. If the organophilic complex is to be further processed in organic phase, an exchange of the cations in the vicinity of 100% is preferred. If the organophilic complex is to be dispersed in an aqueous phase, the degree of exchange is preferably about 20 to 60%.

As a smectitic layered silicate for the preparation of the organophilic complex, montmorillonite, hectorite, saponite, sauconite, beidellite and/or nontronite can be used. For practical purposes, bentonite is used which is available as mineral substance with different exchangeable cations (Na, Ca, Mg) and which has as a main component montmorillonite.

The literature source "*Das Papier,*" Volume 35, No. 9, pages 407 416 (1981) teaches how to treat kaolin with cationic polymers to increase the filler content at equal strength in the paper. However, for the purposes of the present invention, kaolin has too low an ion exchange capacity. Besides, in aqueous phase, kaolin is not film-forming and not hydratable to form a gel.

The organophilic complexes consist preferably of reaction products of the inorganic layered silicate with an organic ammonium compound, preferably a quaternary ammonium compound. Instead of the quaternary ammonium compound, there can be used for the reaction with the inorganic layered silicate other organic compounds with a quaternary onium ion, e.g. quaternary phosphonium compounds. Additionally, usable organophilic complexes are also the partially reacted complexes of the inorganic layered silicates with quaternary onium compounds.

While at full utilization of the reactive valences, the organophilic complex tends to floculate; organophilic complexes with partially reacted inorganic layered silicates, especially in aqueous dispersions, may often still be colloidal solutions. Naturally, only the reacted fraction reacts with the organic solvents of the printing ink, of the lacquer or of the coating material.

Since the fine distribution in a paper sheet or in its surface is of importance for the process of the invention, in order to abolish the capillary suction forces also in the micro range, a preferred use for all aqueous application systems lies in the partially reacted complexes. This leads to a higher consumption or coating weights.

It can be assumed that the organophilic complex after the drying will become an integral part of the intaglio ink or of the solvent coating material or of the lacquer. This may be of importance for the so-called de-inking process, since here the organophilic complex, together with the ink, lacquer or coating material, separates easier from the fibers, allowing for recycling of the fiber portion of the paper.

The wettability of the printing inks, in particular intaglio gravure inks, is influenced especially favorably by the oleophilic nature of the outward-pointing organic radicals of the organophilic complex.

All solvents used for dissolving or dispersing printing inks, lacquers, coating materials or adhesives are suitable as solvents for the invention. Preferably, an organic solvent from the group of toluene, xylene or benzine, possibly in mixture with higher-boiling components, is used in intaglio gravure inks. Such components are customary in printing technology and serve to influence the evaporation behavior in the drying of the ink. For lacquer type coating materials, lacquer solvents, such as esters, acetone and alcohols are normally used.

The invention is usable also for improving the holdout of pressure-sensitive adhesive coating materials. These coating materials contain tacky resins, such as polyacrylates and polyisobutylene, which are in part mixed with plasticizers. Hydrocarbon-base solvents, such as benzine, are used for such coating materials.

Since organophilic complexes swell in organic solvents and/or are present in colloidal dispersions, in such solvents the solids content is limited to or less than 10% by weight. Preferably, the reactive organophilic complex, if coated in organic solvents, is present as a 1.5 to 10% dispersion. The dispersions of the reactive organophilic complexes of the invention in organic solvents are highly thixotropic, this being favorable for applying, e.g. in an intaglio printing unit with a gravure roll.

The organophilic complex may be introduced either into the fibrous material or onto the surface of the fibrous structure.

In particular, for the production of super-calendered papers, the method of the invention can be employed so that the reactive organophilic complex is introduced into the suspended fibrous materials before the production of the flat structure such as paper in aqueous dispersions, with or without fillers.

A variant of the method according to the invention is characterized in that the organophilic complex is produced before the production of the flat structure, in situ, in the fibrous material, by reaction of the inorganic layered silicate with the organic compound. Also, in this reaction, e.g. with a quaternary ammonium compound, the filler suspension alone may be reacted instead of the fibrous material (pulp), or the fibers and filler are already present as total stock.

The advantage of the production in situ, e.g. in the paper mill, resides especially in that the paper machine acts as a dryer also for the organophilic complex, hence energy is saved.

If the two above-stated process variants are carrier out in the paper mill, the usual fillers can in part be replaced by the organophilic complex. Also, the usual retention aids and other additions, such as dyes, can be used.

A process variant which is suitable for the production of coated, highly super-calendered papers involves application of the reactive organophilic complex, possible with a binder, surfactant and/or inert coating pigment, in or on the surface of the flat structure in aqueous suspension. Customary white coating pigments can be used to improve the opacity.

When no contribution to the opacity of a paper sheet is expected of a coating or surface preparation, but when only the printing opacity and hence the ink consumption and the gloss of the print is of primary interest, then, one can produce the organophilic complex in situ in the surface of the flat structure, and the inorganic layered silicate is introduced in the form of an aqueous colloidal dispersion, possibly containing binders, surfactants and/or coating pigments, into the surface for subsequent reaction with the organic compound. This is possible, e.g. in all those coating machines which have two coating heads per side, as is customary today. Especially suitable are also machines with two size presses. First, a film-forming, hydrated bentonite of high swelling capacity is applied in the first size press. A special binder is not required. Then in the second size press, the dilute solution of a quaternary ammonium compound is applied.

Another possibility which requires only one size press or similar applicator, is to introduce the inorganic layered silicate in the form of an aqueous colloidal dispersion, into the fibrous material and subsequently to react it only in the surface with the organic compound, to obtain the organophilic complex. The aqueous silicate colloidal dispersion may also contain binders, surfactants or pigments.

In this case, one adds preferably 3 to 5% by weight of the hydrate inorganic film-forming layered silicate, referred to the total stock onto the paper pulp.

Instead of producing the organophilic complex in situ on the surface, it may be produced by reaction of the inorganic layered silicate with the organic compound in the presence of binders, surfactants and/or coating pigments. The reaction product can then be brought into or onto the surface of the fibrous material as a coating slurry.

All these process variants for the production of coated papers are carried out in the paper mill.

Another process variant involves the application of the reactive organophilic complex by means of a solvent coating machine or printing machine in or on the surface of the flat structure. After an intermediate drying, the printing ink, lacquer or coating material is applied. The organic solvent suspension of the organophilic complex may also contain a binder or an opacity-increasing pigment.

The reactive organophilic complex of the invention can be applied with a so-called solvent coater at high speeds and in the widths of modern paper machines (about 7 to 8 meters).

The advantage of such solvent coating machines is, among others, that there is a great degree of freedom with respect to the coating application as well as the admixture of opacifying pigments or of binders.

Since, at the printers, in many case no ink runs in web-fed intaglio roto gravure printing machines in the first printing unit, the paper being only "prestretched," and since in many large-scale printing establishments 4, 5 or 6 printing unit per side are provided, which are not used in all cases, the method according to the invention can be carried out to advantage also in the printing establishment.

A printing unit, e.g. a simple screen intaglio gravure printing unit, can, in the above-described process variant, thus be used for producing an invisible preprint of the organophilic complex, which is intermediately dried as usual before the actual intaglio gravure printing begins.

The costs for intaglio gravure printing are moderate if, as is normally the case, 92 to 96% of the solvent is recovered. Since, according to the invention, the organic dispersing agent for the organophilic complex is the same as for the solvent for the subsequent printing inks, the joint recovery presents no problems. The prestretch unit, that is, the first printing unit here being employed, can keep its function as such, because the preprint with the reactive organophilic complex can be printed all over and without register holding.

With this process variant, it is also possible to introduce the organophilic complex only partially into the surface of the flat structure. In these areas, the printing ink appears glossy, while in the untreated areas, which contain no organophilic complex in the surface, the ink is absorbed and therefore appears dull.

In general, the same or similar organic solvents can be used as dispersing agent for the reactive organophilic complex and the printing ink(s) or the lacquer or the coating material.

The invention further relates to a composition for the performance of the above-described process variant, which is applied on the surface of the fibrous structure. This is present in the form of a dispersion of a reactive organophilic complex either in an aqueous or organic medium.

The reactive organophilic complex is present in the form of a 1.5 to 10% dispersion. An organic solvent, such as toluene or xylene is preferred. In an aqueous medium, the reactive organophilic complex is preferably present in a 2 to 20% dispersion.

The invention further relates to flat fibrous structures, such as paper, which are characterized in that they contain in the surface and/or in the fibrous material, a reactive organophilic complex which is obtainable by the method according to the invention.

If the organic complex is contained in the surface of the flat structure, according to the invention, it is present, preferably finely divided, in a quantity of 0.1 to 3, preferably 0.2 to 0.8 $g/m^2$ and side. If it is contained in the fibrous material, it is present preferably in a quantity of about 1.5 to 12% by weight.

The invention can also be applied for the production of zinc oxide papers. In these papers, a toluene lacquer, which is filled with photo-semiconducting zinc oxide and non-conducting binders, is spread onto the surface of a conductive untreated paper. The conductivity of the raw paper is obtained in that a conductive polymer is added to the size press preparation of starch ethers or esters or of polyvinyl alcohol. The toluene lacquer behaves analogously to a printing ink. Because of the barrier effect of the reactive organophilic complex in the fibrous material or in the surface of the fibrous structure, the toluene lacquer filled with zinc oxide is prevented from penetrating into the fibrous material.

Until now, a holdout for toluene without pin-holes could be obtained only at great expense, involving the steps of partly double size press coating, and partly precoating with the conductive polymer and with the colloidal binder. By addition of the reactive organophilic layer silicate into the size press preparation and/or into the precoat, it is possible to obtain a pinhole-free toluene density for the coating.

At all those areas where the conductive raw paper has a defect, i.e. absorbs toluene, there occurs in the surface of the zinc oxide paper a defect in the image reproduction. By the additional use, according to the invention, of the reactive organophilic layered silicates, these defects can be eliminated.

The present invention can be employed also to prevent the penetration of lacquers such as nitro lacquer, zapon varnish, synthetic resin lacquer, spirit lacquers, etc., into fibrous structures. As an example, label papers are over-lacquered after printing with a so-called label protection lacquer, so that the labels on the bottles will be resistant to abrasion and will not become unsightly through absorption of moisture.

For a label paper to be lacquerable, it usually must be coated on one side. So-called natural label papers cannot be lacquered, as the lacquer does not stay on the surface, but penetrates into the fibrous material. The new reactive barrier layer of the organophilic complex prevents penetration of the label lacquer into the fibrous materials.

Additionally, it should be noted that by the precoating of a paper surface or of another extended fiber structure with the spontaneously reacting organophilic complexes, materials can be made printable, in particular lacquerable and coatable from organic solution, where this was practically not possible until now. This includes, besides the nonwoven materials, the simple wood-containing and wood-free natural papers, that is, also those which are not filled or barely so and which had not been calendered.

Under this aspect, the invention is particularly important for cardboard, where, whether coated or not, each supercalendering and each smoothing in a smoothing unit leads to an undesired volume loss and hence rigidity loss.

The invention is further suitable for the production of adhesive labels.

Pressure-sensitive adhesive coatings are applied in most case from an organic solution of the adhesives. Here, the absorption of the adhesive coating materials into the paper plays an important part. In fact, they should penetrate into the paper as little as possible. Attempts have been made in the past to improve the holdout with expensive size press preparations, e.g. casein or polyvinyl alcohol. Here, too, coating with the reactive organophilic complex not only leads to a reduction of the adhesive application, but it also allows the use of previously undesirable or unsuitable materials, such as nonwoven or textile materials. These materials can also be made printable through the process of this invention.

If the organophilic complexes contain quaternary ammonium compounds, they influence the electrical properties of the flat structures of the invention, e.g., the surface or volume resistance. These values may be important for the printability. By modification according to this invention, the surface and volume resistances are reduced, thereby eliminating disturbances which are caused by electrostatic charges.

The invention is explained by the following examples in a non-limiting manner.

EXAMPLE 1

A semi-bleached softwood sulfate cellulose is beaten in a pulper at a consistency of 5% and a pH values of 7 to 7.8 and then brought to a freeness of 26° SR (Schopper-Riegler) in a refiner.

This cellulose is mixed in a pulp mixing center in a ratio of 25:75 with a chip-free mechanical wood pulp of a freeness 78° SR. A separately produced kaolin slurry of 40% at a pH value of 7 to 7.8 is admixed to the fiber mixture in the ratio of 70 parts fibers to 30 parts kaolin (all calculated air dry). To this total stock, a slurry of 3.5% solids of a preswelled sodium bentonite having an ion exchange capacity of 90 milliequivalents/100 g is admixed, until, referred to fibers and filler, 4% by weight of the bentonite is added. The whole is mixed well for about 10 minutes. Thereupon, an equimolar amount of 4% aqueous solution of dimethyl-benzyl-alkyl ($C_{12}$–$C_{22}$) ammonium chloride is admixed for the complete ion exchange.

After a mixing time of 15 minutes, paper is produced from this stock on a paper machine after dilution to 0.6%, having a weight of 40 g/m$^2$ and discharged upon drying to a residual moisture content of 8.5% by weight. Thereafter, the paper is calendered on a super calender. It has a Bekk smoothness of 900 sec at a density of 1.10 g/cc. It contains about 5% by weight, referred to the total stock, reactive organophilic bentonite. It has a toluene holdout (measured by the drop method, with 0.05 ml toluene, which is stained with Ceres Red) of 65 sec, compared with 36 sec for an otherwise identical paper without the organophilic bentonite. The organophilic bentonite adheres well to the fibers and fillers.

The small amount of NaCl is no trouble in the effluent.

EXAMPLE 2

A commercial organophilic bentonite laden with quaternary ammonium ions (TIXOGEL VZ ® of Süd-Chemie AG) is mixed for 15 minutes in a high-speed mixer with high shearing forces as dispersion with a solids content of 20% by weight in the presence of a non-ionogenic surfactant of the nonyl phenolethoxylate type. This dispersion is admixed to the fibers produced according to Example 1. Thereafter, the kaolin slurry is added, in a quantity that, referred to the total stock, 6% by weight of the reactive organophilic clay is in the total stock. The 60 g/m$^2$ sheet produced in conventional manner after dilution and adjustment of the pH value to 5.8, has a content of 5.5 to 6% by weight of the organophilic clay. After super-calendering with heated steel rolls at 90° C., it has a smoothness of 1300 Bekk-sec. and a toluene holdout of 50 sec.

EXAMPLE 3

A wood-containing, coating base stock containing a 55% by weight fraction of semi-bleached softwood sulfate cellulose, a 45% by weight fraction of mechanical wood pulp and having a weight of 38 g/m$^2$, is coated with a coating material of the following composition:

96 parts coating kaolin 4 parts finely dispersed reactive organophilic bentonite in the form of a 20% by wt. aqueous dispersion according to Example 2.

These components are mixed intensively in a Caddy mixer. Then 4.5 parts of a plastic dispersion consisting of a copolymer of styrene and acrylic acid as intaglio binder and additionally 1.5 parts of a fully saponified medium-viscous polyvinyl alcohol are added. The pH value is adjusted to 8.5. The solids content of the coating material is adjusted to 50% by weight.

After the coating of 7 g/m$^2$ and side, a coated intaglio paper is produced which, after calendering, has a Bekk smoothness of 1500 to 1600 sec and a toluene holdout of 65 sec. A comparable coated intaglio paper has a toluene holdout of 40 sec.

EXAMPLE 4

In accordance with Example 1, a wood-containing, kaolin-filled, calendered natural intaglio gravure paper, without bentonite or quaternary ammonium compound in the mass, is produced.

In a coating machine with two coating heads per side and respective intermediate drying, there is applied in the first and third coating units a 5% slurry of a commercial bentonite, the exchangeable cations of which are 40% Na and 60% Ca cations. The coating weight is about 1.5 g/m$^2$ and side.

In the coating units 2 and 4, after intermediate drying a 4% solution of the quaternary ammonium compound of Example 1 is applied in the ratio indicated there. This solution reacts by ion exchange in the surface with the applied bentonite, with formation of the reactive organophilic complex. Since both the hydrated bentonite is film-forming and also the reactive organophilic complex forms a film, if a weakly adhering one, the additional use of colloidal and/or dispersed binders is not necessary.

EXAMPLE 5

A wood-containing, highly-filled paper which had been manufactured according to EUP No. 0,017,793 with a film-forming colloidal bentonite whose sodium:-magnesium atomic ratio was 60:40 and contains, referred to the paper, 2.5% by weight of the film-forming bentonite, is treated at the end of the dry section of a paper machine by means of a conventional size press with the dilute 3% aqueous solution of the quaternary ammonium compound of Example 1. Since the fibers and fillers of this paper carry a coating, if a thin one, of film-forming bentonite, the latter enters into ion exchange with the quaternary ammonium compound and produces the reactive organophilic complex in the surface.

The resulting sodium and magnesium chlorides caused no trouble.

EXAMPLE 6

In many factories which deal with the upgrading of paper, so-called solvent coaters are set up. These are coating machines which use various organic solvents as solvent or dispersing agent, instead of water. These are recovered from the exhaust air.

A wood-containing, natural intaglio paper with a weight of 40 g/m$^2$ has a filler content of 18% by weight. Its opacity and its print opacity are unsatisfactory.

A commercial bentonite, laden with quaternary ammonium ions (TIXOGEL VP® Süd-Chemie AG) is dispersed for 10 minutes in a strongly-shearing, high-speed mixer in the form of a dispersion with a solids content of 3.5% by weight in a solvent mixture of 99 parts by weight toluene and 1 part by weight ethanol. This dispersion is applied on both sides of the paper by means of a reverse-roll coater, so that there would result per side 0.5 g/m$^2$ application (calculated air dry).

While the uncoated paper has a toluene holdout of 5 sec, the paper thus pretreated has a toluene holdout of 60 sec. The print with a black intaglio ink shows almost no strike-through on the back and an increased print gloss and higher blackness.

EXAMPLE 7

There are in an intaglio gravure printing machine, four printing units per side. But only a three-color intaglio is to be printed. Normally, the first printing unit is allowed to run along without ink, to prestretch the paper web.

In this first printing unit, by means of a gravure roll with a No. 70 screen and a gravure depth of 65 μm, a colorless preprinting ink is preprinted all over and without regard to exact register with a 3% (by weight) colloidal dispersion in toluene, prepared in analogy to Example 6. This preprint places, after the usual drying, a film of the organophilic complex of 0.3 g/m$^2$ on the paper to be printed. While for a little-filled wood-containing natural paper the absorption time for partially-colored toluene solution is about 6 sec, there results on the "preprinted" paper a film of the organophilic complex of 0.3 g/m$^2$ in a holdout time of 70 sec. A further increase of the application of reactive organophilic complex from the toluene solution, e.g. 0.6 g/m$^2$, does not give a higher value or a sharper hold of the partially-colored toluene drop, because with a film of only 0.3 g/m$^2$, a complete sealing of the printing paper against toluene has already occured.

EXAMPLE 8

As the improvement of the holdout for solvent-containing printing inks is linked with an increase of the gloss of the ink to its maximum value, it becomes possible to obtain in the first printing unit partially printed areas with the 3% (by weight) colloidal dispersion in toluene according to Example 7. All subsequent prints on unpretreated area parts absorb and result in a dull print.

All intaglio inks reaching the pretreated area parts remain on the print surface and develop their maximum possible print gloss. Thus, for example, in an advertisement, the article to be advertised can be made to stand out with a high gloss on a dull background.

Let it be stressed once more regarding Examples 7 and 8 that when preprinting a colloidal dispersion of the reactive organophilic complex, a binder is not necessary for the reason that the film-forming ability of these products is great enough to ensure sufficient adhesion.

In all those cases where one or more additional inks are printed on the preprint also with toluene, it must be assumed that this preprint becomes an integral part of the entire print.

EXAMPLE 9

A wood-free label paper is produced from 60 parts by weight of highly-bleached soft wood sulfate cellulose with a freeness of 30° SR and 40 parts by weight of bleached birch sulfate cellulose with a freeness of 45° SR. To improve the opacity, there are added 10 parts by weight kaolin, 5 parts by weight $TiO_2$ and 5 parts by weight aluminum hydroxide. The paper is run with 2.5 parts by weight rosin size with addition of a pH value of 4.6 at a Yankee paper machine, smooth on one side and is heated at the end of the dry section to 136° C. to ensure crosslinkage of the melamine-formaldehyde resin. This label paper is to be treated with an anti-abrasion lacquer.

The label printing is done in gravure printing, a dispersion of the reactive organophilic complex according to Example 6 in toluene being preprinted in the first intaglio printing unit. After the graphic print, the label protection lacquer is applied as nitro lacquer. It does not penetrate into the natural printing paper treated according to the invention, although this paper is not coated.

In all cases of Examples 7, 8 and 9, it is advisable to use the same organic solvent possibly also with admixtures of high-boiling substances, so that the condensate obtained from a solvent recovery plant can be re-used uniformly.

EXAMPLE 10

An uncoated chrome imitation board having a substance of 300 g/m$^2$ was printed with a dispersion according to Example 6 in intaglio printing, the dried pre-treatment being only 0.2 g/m$^2$. On a board thus pretreated, a nitro lacquer which would otherwise be absorbed, remains and stays glossy.

EXAMPLE 11

A nonwoven material of 80% polyester fiber and 20% bleached softwood sulfate cellulose as dispersion fiber is impregnated with a synthetic dispersion of polyacrylic acid ester after its production on an inclined wire machine in aqueous suspension.

This nonwoven material is to be prepared for textile screen printing. Like the intaglio inks, screen printing inks have low viscosity and may contain toluene as solvent. In a conventional coating machine for organic solvents, a 3.5% (by weight) suspension of the organophilic complex according to Example 6, which is blended with another 5% (by weight) of a fine calcium carbonate and contains a polyvinyl acetate addition of 2% by weight, is applied. It is here advisable to choose the blade coating method, so that the large pores of the nonwoven material will be closed.

While in an untreated, nonwoven material, a toluene-containing screen printing ink has a toluene holdout of 10 to 15 sec, the holdout is improved by the coating to about 40 sec. The attainable print gloss is increased and the consumption of screen printing ink reduced.

EXAMPLE 12

To a suspension of bleached softwood sulfate cellulose of a consistency of 4.5% by weight and a freeness of 23° SR, there is admixed a fully swelled Na-Mg bentonite slurry with 5% by weight solids until, referred to the cellulose, a percentage of 10% by weight is reached.

Then, a bleached birch sulfate cellulose also of a consistency of 4.5% by weight, with a freeness of 40° SR is added, namely in the ratio 1:2 softwood to birch cellulose. The content of Na-Mg bentonite now is, based on total fibers, 3.3% by weight.

In a separate dissolving vessel, a 3% (by weight) solution of the quaternary ammonium compound according to Example 1 is produced.

This solution, in a quantity sufficient for the exchange of 30% of the exchangeable cations, is stirred into the fiber-bentonite mixture by intensive mixing. The woodfree paper thus produced according to standard methods has at 80 g/m$^2$ a Bekk smoothness of 1100 sec, a density of 1.35 g/cm$^2$, and a toluene holdout according to the drop method (toluene stained with Ceres Red) of 15 sec as against 3 sec for untreated paper.

I claim:

1. Method of treating paper for improvement of holdout of a printing ink contained in an organic solvent in a rotogravure printing process, which comprises the steps of:

A. forming an organophilic layered silicate complex by:

1. reacting a water-insoluble hydrated, cation-exchangeable, film-forming smectitic layered silicate, having inorganic cations and having an ion-exchange capacity of at least 50 milliequivalents/100 g. with organic quaternary onium cations having attached carbon chain radicals containing between 12 and 22 carbon atoms;

B. introducing said organophilic layered silicate complex onto said paper;

C. applying an ink or coating composition suspended in an organic solvent onto said paper;

D. initiating an instantaneous physico-chemical reaction between said carbon chain radicals of said organophilic complex and said organic solvent and absorbing the solvent to prevent its penetration into the fibers of said paper; and E. evaporating the solvent from said organophilic complex.

2. Method, as defined in claim 1, in which said cation-exchangeable layered silicate has an ion-exchange capacity in the range of from 50 to 130 milliequivalents/100 g.

3. Method, as defined in claim 1, in which the cation-exchangeable layered silicate is ion-exchanged to the extent that at least 20% of the exchangeable cations are exchanged with carbon chain radicals.

4. Method, as defined in claim 1, in which the smectitic layered silicate includes montmorillonite, bentonite, hectorite, saponite, sauconite, beidellite and nontronite.

5. Method, as defined in claim 1, in which the onium compound is an organic ammonium compound.

6. Method, as defined in claim 5, in which the organic ammonium compound is a quaternary ammonium compound.

7. Method, as defined in claim 1, in which the reactive organophilic complex is applied on the surface of the flat structure in aqueous suspension.

8. Method, as defined in claim 1, in which the inorganic layered silicate is applied to the surface of the paper in the form of an aqueous colloidal dispersion, and wherein the carbon chain radicals derived from an onium compound, are thereafter applied to the paper, and reacted with the smectitic layered silicate contained therein.

9. A method, as defined in claim 1, in which the carbon chain radicals, derived from an onium compound, are applied to the surface of the flat, fibrous structure, and thereafter an aqueous colloidal dispersion of the smectitic layered silicate is applied to the surface of the flat, fibrous structure and reacted with the organic compound contained therein.

10. A method, as defined in claim 1, in which the organophilic complex is produced by reaction of the inorganic layered silicate with the onium compound in the presence of binders, surface-active agents, or coating pigments and thereafter, the reaction product is applied as a coating material in or on the surface of the paper.

11. Method, as defined in claim 1, in which the reactive organophilic complex is selectively applied to a portion of the surface of the paper.

12. A method, as defined in claim 1, in which the organophilic complex is present in a dispersion, in a concentration of 1.5 to 10% by weight.

13. A flat web of paper suitable for use with a rotogravure printing ink suspended in an organic solvent, which has on its surface an organophilic complex comprising:

A. a water-insoluble, hydrated, cation-exchangeable, film-forming, smectitic layered silicate, having an ion-exchange capacity of at least 50 milliequivalents/100 g.; and B. quaternary onium cations having attached carbon chain radicals ion-exchanged with said smectitic layered silicate, in which said carbon chain radicals contain between 12–22 carbon atoms.

14. A web of paper, as defined in claim 13, in which the reactive organophilic complex is present in the paper web in the range of 1.5–12% by weight.

15. A method of treating a flat web of paper prior to rotogravure printing to improve the de-inking of the fibers of the printed paper during recycling, which comprises the steps of:

A. forming an organophilic complex by:

1. reacting a water-insoluble, hydrated, cation-exchangeable, film-forming, smectitic layered silicate, having inorganic cations and having an ion-exchange capacity of at least 50 milliequivalents/100 g., with organic quaternary onium cations having attached carbon chain radicals containing between 12 and 22 carbon atoms;

B. introducing said organophilic layered silicate complex onto said web of paper;

C. applying an ink suspended in an organic solvent onto said paper;

D. initiating an instantaneous physico-chemical reaction between said organophilic layered silicate complex and said organic solvent;

E. absorbing said solvent and preventing penetration of said solvent into said web of paper.

16. A method of improving the holdout of a rotogravure printing ink contained in an organic solvent and preventing excessive penetration of said solvent into the fibers of a web of paper during rotogravure printing, which comprises the steps of:

A. forming an organophilic layered silicate complex by:

1. reacting a water-insoluble, hydrated, cation-exchangeable, film-forming, smectitic layered silicate, having inorganic cations and having an ion-exchange capacity of at least 50 milliequivalents/100 g., with organic quaternary onium cations having attached carbon chain radicals containing between 12 and 22 carbon atoms;

B. introducing said organophilic layered silicate complex into an aqueous solution of suspended fibers;

C. forming said aqueous solution of suspended fibers and said organophilic layered silicate complex into a web of paper;

D. applying a rotogravure ink suspended in an organic solvent onto said web of paper;

E. initiating an instantaneous physico-chemical reaction between said carbon chain radicals of said organophilic complex and said organic solvent and absorbing said organic solvent and preventing its penetration into the fibers of the web of paper; and F. evaporating the solvent.

* * * * *